US007027004B2

(12) United States Patent
Haunberger et al.

(10) Patent No.: US 7,027,004 B2
(45) Date of Patent: Apr. 11, 2006

(54) OMNIDIRECTIONAL BROADBAND ANTENNA

(75) Inventors: Thomas Haunberger, Bad Reichenhall (DE); Dieter Zierhut, Bad Aibling (DE)

(73) Assignee: Kathrein-Werke KG, Rosenheim (DE)

( * ) Notice: Subject to any disclaimer, the term of this patent is extended or adjusted under 35 U.S.C. 154(b) by 1 day.

(21) Appl. No.: 10/738,207

(22) Filed: Dec. 18, 2003

(65) Prior Publication Data

US 2005/0134511 A1 Jun. 23, 2005

(51) Int. Cl.
*H01Q 9/04* (2006.01)

(52) U.S. Cl. ..... 343/790; 343/791

(58) Field of Classification Search ..... 343/749, 343/745, 752, 715, 829–831, 872, 900, 790, 343/791

See application file for complete search history.

(56) References Cited

U.S. PATENT DOCUMENTS

| | | | | |
|---|---|---|---|---|
| 2,501,020 | A | 3/1950 | Barnes | 343/872 |
| 2,511,849 | A | 6/1950 | Hilferty et al. | 343/773 |
| 3,419,872 | A | 12/1968 | St. Vrain | 343/792 |
| 3,740,754 | A | 6/1973 | Epis | 343/797 |
| 4,074,268 | A | 2/1978 | Olson | 343/773 |
| 4,218,685 | A | 8/1980 | Frosch et al. | 343/797 |
| 4,254,422 | A | 3/1981 | Kloepfer et al. | 343/792 |
| 4,814,777 | A | 3/1989 | Monser | 343/727 |
| 4,890,116 | A | 12/1989 | Lewis, Jr. | 343/749 |
| 4,972,196 | A | 11/1990 | Mayes et al. | 343/700 MS |
| 5,451,968 | A | 9/1995 | Emery | 343/749 |
| 5,710,569 | A | 1/1998 | Oh et al. | 343/817 |
| 5,966,102 | A | 10/1999 | Runyon | 343/797 |
| 6,028,563 | A | 2/2000 | Higgins | 343/797 |
| 6,034,649 | A | 3/2000 | Wilson et al. | 343/795 |
| 6,127,979 | A * | 10/2000 | Zhou et al. | 343/702 |
| 6,404,396 | B1 * | 6/2002 | Hung et al. | 343/749 |
| 2003/0103008 | A1 | 6/2003 | Petropoulos et al. | 343/702 |
| 2004/0201537 | A1 | 10/2004 | Stolle et al. | 343/797 |

FOREIGN PATENT DOCUMENTS

| | | | |
|---|---|---|---|
| DE | 37 09 163 | C2 | 10/1987 |
| DE | 3639106 | A1 | 5/1988 |
| DE | 196 27 015 | A1 | 1/1998 |
| DE | 197 22 742 | A1 | 12/1998 |
| DE | 198 23 749 | A1 | 12/1999 |
| DE | 100 12 809 | A1 | 9/2001 |
| DE | 101 50 150 | A1 | 5/2003 |
| DE | 103 16 564 | A1 | 11/2004 |
| WO | WO 97/22159 | | 6/1997 |
| WO | WO 00/39894 | | 7/2000 |
| WO | WO 02/50940 | A2 | 6/2002 |
| WO | WO2004/091050 | A1 | 10/2004 |

* cited by examiner

OTHER PUBLICATIONS

Ch.Braun et al, "Elektrisch kurze Antennen zur Feldmessung", Fraunhofer-Institut für Naturwissenschaftlich-Technische Trendanalysen (INT) (Mar. 1996).

*Primary Examiner*—Wilson Lee
*Assistant Examiner*—Ephrem Alemu
(74) *Attorney, Agent, or Firm*—Nixon & Vanderhye P.C.

(57) ABSTRACT

A broadband omnidirectional antenna includes an antenna element projecting from a base plate or counterweight surface. The antenna element has an outer surface which extends away from the base plate. The base plate has a recess in the area of which the foot point of the antenna element (which is in the form of a monopole) is arranged such that it is electrically conductively isolated from the base plate or from the counterweight surface. The antenna element is fed by means of a series or capacitive inner conductor line coupling.

30 Claims, 6 Drawing Sheets

OMNIDIRECTIONAL BROADBAND ANTENNA

FIELD

The technology herein relates to an antenna, in particular to an omnidirectional antenna. Still more particularly, the technology herein relates to a broadband omnidirectional antenna having an antenna element in the form of a monopole which projects from a base plate or counterweight surface and having an outer surface which extends away from the base plate, the base plate having a recess in the footprint area of the monopole antenna element, the antenna element being electrically conductively isolated from the base plate or counterweight surface.

BACKGROUND AND SUMMARY

Omnidirectional antennas are known. One illustrative example form of omnidirectional antenna is so called indoor antennas which have a multiband capability and preferably transmit and receive with a vertical polarization. They have a base plate on which an antenna element which is in the form of a monopole projects transversely from, that is to say at right angles to, the base plate. The entire arrangement is generally covered by means of a protective housing (radome).

In such example antennas, a recess is generally incorporated in the center, or slightly offset in the vicinity of the center, on the base plate. Generally, the base plate is metallic or at least conductive, and generally has a circular shape in a plan view. In the recess, a plug element for a plug connection is generally anchored Generally, the plug element includes a contact element in the form of a plug (i.e., male connector). A coaxial cable in the form of a second plug element, generally in the form of a plug element in the form of a female connector, can generally be connected there, from underneath. The outer conductor in this case makes contact with the base plate. The inner conductor of the feed cable is electrically connected via the plug contact that is provided on the base plate to the antenna element. The antenna element is generally in the form of a monopole and projects from the base plate. The inner conductor is electrically conductively isolated from the base plate, and thus from the outer conductor of a coaxial cable to be connected.

Omnidirectional antennas such as these may be designed such that they can transmit and receive simultaneously in two or more frequency ranges and/or simultaneously in two or more frequency bands.

Indoor omnidirectional antennas of this type have previously been produced and marketed by Kathrein-Werke K G. By way of example, these indoor omnidirectional antennas can transmit and receive simultaneously in the following frequency ranges:

| | |
|---|---|
| 824 | 960 MHz |
| 1425 | 1710 MHz |
| 1710 | 1880 MHz |
| 1850 | 1990 MHz |
| 1920 | 2170 MHz |

Antennas with a multiband capability are likewise known, are produced and marketed by Kathrein-Werke and, for example, can be operated simultaneously at the following frequencies:

| | |
|---|---|
| 876 | 890 MHz |
| 890 | 960 MHz |
| 1710 | 2170 MHz |
| 2170 | 2500 MHz |

While much work has been done in the past in connection with the design of indoor omnidirectional multiband antennas, further improvements are possible and desirable.

The technology herein provides a physically comparatively very small antenna which has a multiband capability, that is to say it has a very broad bandwidth overall, and which can also be used as an omnidirectional antenna. The antenna technology herein is able to operate simultaneously over even wider bandwidths.

It must be regarded as very surprising that a greatly widened bandwidth for simultaneous operation in widely differing frequency ranges is possible by means of a single physically very small antenna. This is accomplished, in exemplary illustrative non-limiting example implementations herein, by the antenna being fed by means of a series or capacitive line coupling at the "foot point" of the antenna element.

Very wide bandwidths are possible in this way. By way of example, the antenna can be operated without any problems simultaneously in the 800 to 1000 MHz band, in the 1400–3500 MHz band, or else, for example, in the 5000 to 6000 MHz band. Owing to the series (capacitive) line coupling, there may be resonances in the upper band.

One exemplary illustrative non-limiting implementation of an antenna, which is like a monopole, is preferably rotationally symmetrical, or is preferably designed to be rotationally symmetrical at least in specific angle ranges. It can have at least one section which widens conically in the longitudinal direction of the antenna. This section can be in the form of a monopole. The antenna may also be designed such that only its external shape is conical, overall.

The antenna may thus in principle also be radially symmetrical or may transmit and receive symmetrically, that is to say it may have a cross sectional shape such that the antenna can be made to be coincident when it is rotated through a specific angle in a plane about a central axis. This may, for example, apply solely to the antenna element or, for example, solely to the base plate, or to both.

Alternatively, the antenna element, which is in the form of a monopole or is similar to a monopole, may be cylindrical.

The antenna element, which is in the form of a monopole, of the antenna is preferably in a form, however, which is subdivided into a first section, which widens conically away from the base plate, and a cylindrical second section, which is adjacent to it. In other words, the antenna element is preferably formed from a combination of a conical antenna element section and a cylindrical antenna element section. The conical part of the antenna element primarily acts as a monopole for the upper frequency bands. The cylindrical part of the antenna element, in contrast, interacts with the associated counterweight surface (base plate) more for the lower frequencies. As a positive feature, it should be noted that this means that no reaction can be found from the cylindrical part on the upper frequency bands.

The series and/or capacitive line coupling may comprise a series and/or capacitive inner conductor coupling. Such coupling is preferably provided via a first coupling part, connected to the feed line (inner conductor of a coaxial conductor), in the form of a rod that projects from the base plate and is isolated from the base plate. The second coupling part, which is coupled to it, is connected to the antenna element, or is part of the antenna element. The second coupling part is preferably tubular. In particular, in order to achieve protection against rotation, the coupling part may also be in the form of a polygon or the like, that is to say, for example, it may have an n sided polygonal cross section.

In general terms, the cross sectional shape may be designed such that it has at least one shape that is not circular. This allows the antenna element, which is similar to a monopole and is formed from a combination of a conical surface and a cylindrical section adjacent to it, to be fitted by means of its internal tubular section (which projects from the foot point of the antenna element) directly onto the first coupling part, which is in the form of a rod and is connected to the feed cable. Since the first and second coupling parts, that is to say the feed line and the antenna element which is in the form of a monopole, are conductively isolated in order to produce series line coupling, an isolating sleeve of the first coupling part is preferably fitted, onto which the second coupling part of the antenna element, which is in the form of a monopole, can be fitted.

This also results in very simple assembly and installation, since the antenna element can be mounted, without any soldering and just by pushing it on, above the base plate on the first coupling part, which is connected to the feed line, and with the interposition of an insulating isolator.

However, the isolator need not necessarily be composed, for example, of a plastic material with a dielectric constant which can be selected in advance. Air may also be used as an isolator. In this case, all that is necessary is to use a suitable centering device and/or spacer in order to ensure that the fitted antenna element cannot make an electrically conductive contact with the coupling part under discussion, which is in the form of a rod and projects from the base plate, and/or with the base plate itself.

The series feed also makes it possible to minimize the antenna element's height in comparison with the conventional solution. This also makes it possible to reduce the counterweight area (base plate), thus making it possible to achieve a comparatively small physical size.

BRIEF DESCRIPTION OF THE DRAWINGS

Exemplary illustrative non-limiting example implementations will be explained in more detail in the following text with reference to the drawings, of which.

DETAILED DESCRIPTION OF EXEMPLARY ILLUSTRATIVE NON-LIMITING IMPLEMENTATIONS

Figure 1A:
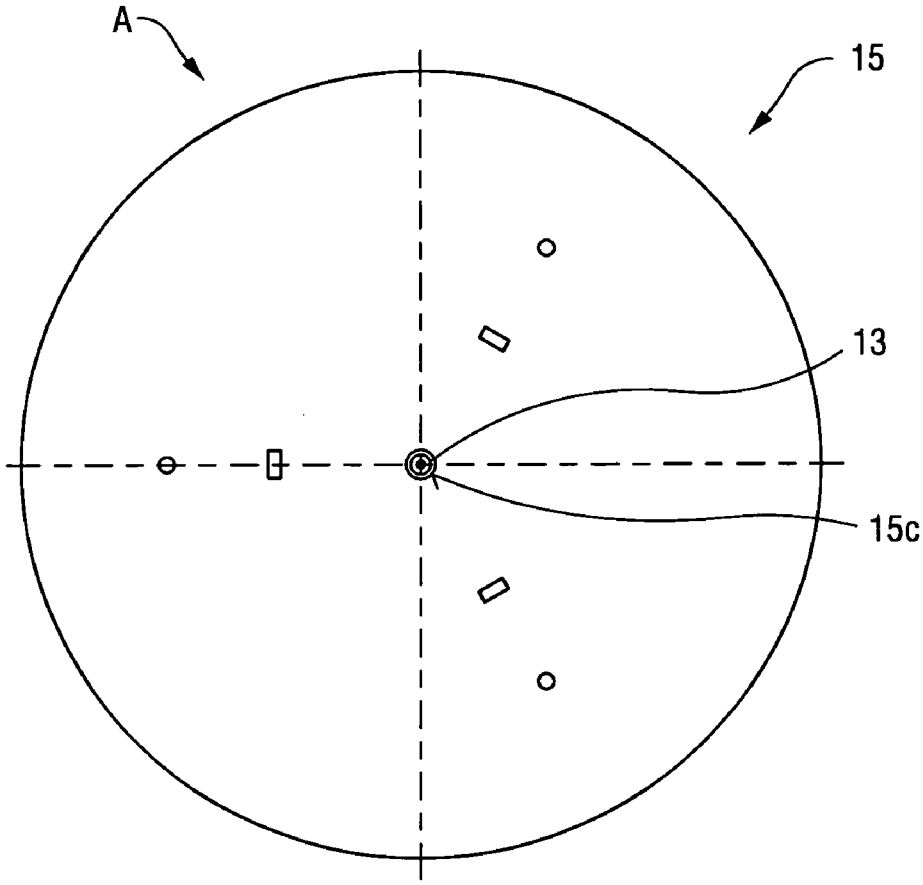
FIG. 1*a* shows a schematic plan view of an exemplary illustrative non-limiting implementation of an omnidirectional broadband; antenna
Figure 1B:
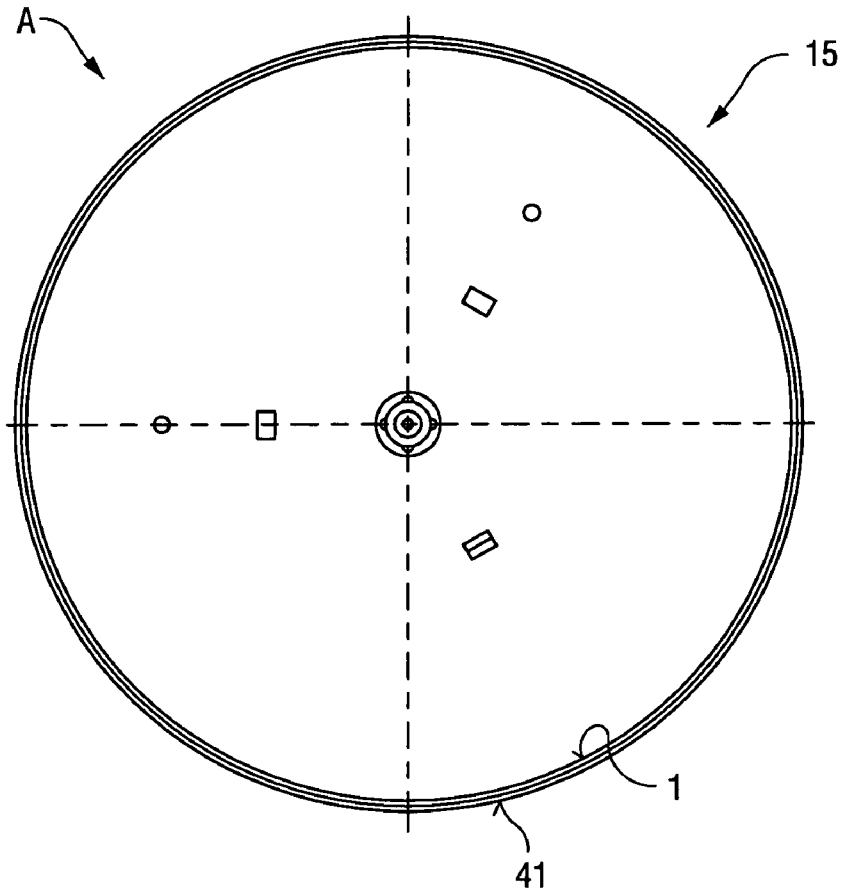
FIG. 1*b* shows a view from underneath of the FIG. 1*a* antenna.
Figure 2:
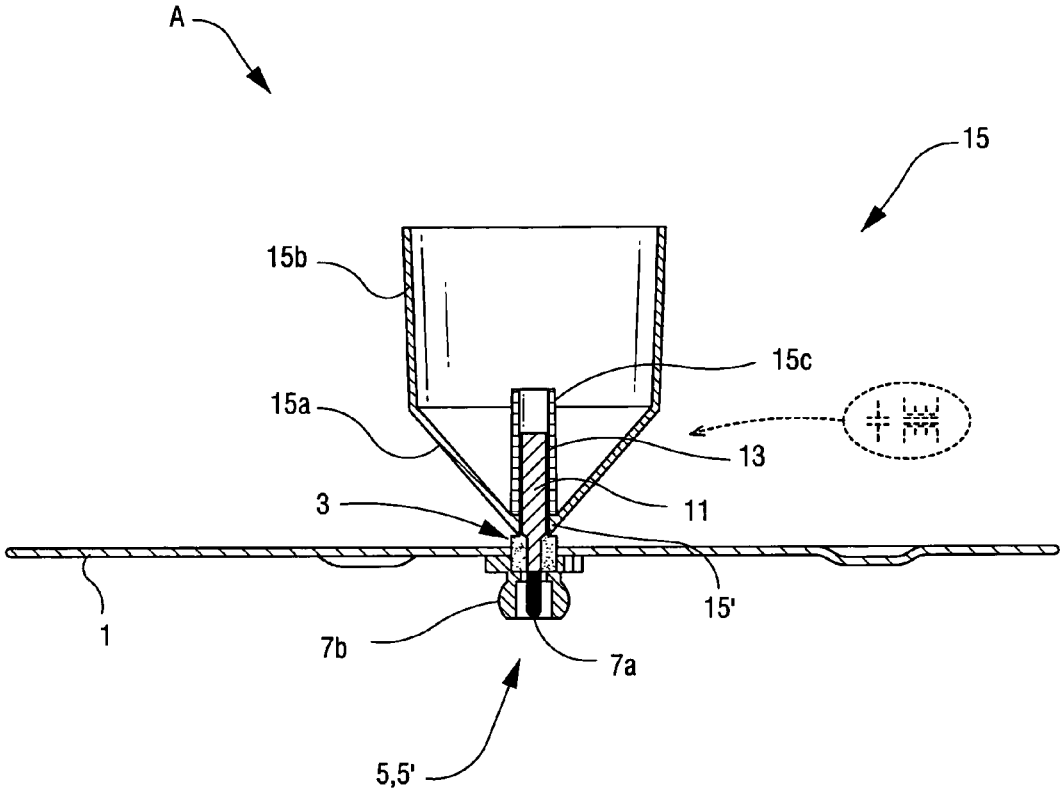
FIG. 2 shows a schematic vertical cross section through the axial center of the FIG. 1*a* antenna.

A first exemplary illustrative non-limiting implementation of an antenna A has an antenna element 15 shown in the form of a schematic plan view in FIG. 1*a*, in the form of a schematic view from underneath in FIG. 1*b*, and in the form of a vertical cross sectional illustration, passing through the central axis, shown in FIG. 2.

The antenna A has a base plate or ground plate 1 which, in the illustrated exemplary implementation, is circular or is in the form of a disk. This base plate or ground plate 1 may, however, also have a completely different shape. For example, it may be square, rectangular, oval etc. In general, it may also be n sided polygonal or may have any other desired basic shapes and boundary lines. The plate 1 is essentially referred to in the following text as the base plate 1. The base plate 1 in this case also, inter alia, carries out the function of a counterweight surface.

A recess 3 is incorporated in the center of the base plate 1. A plug element 5 is positioned and attached in and underneath the recess 3 and, in the illustrated exemplary implementation, is in the form of a coaxial plug element 5'. The outer conductor 7*a* of the plug element 5 is electrically conductively connected to the base plate 1. The inner conductor 7*a* of the plug element 5 is passed through the recess 3, isolated from the outer conductor 7*b*, and is electrically conductively connected to a first or a feed side coupling element 11 which extends above the base plate 1. This coupling element 11 is transverse with respect to the base plate, that is to say it is vertical in the illustrated exemplary implementation. It is in the form of a rod and may preferably have a circular cross section.

A tubular isolator element 13 is fitted on this coupling element 11. This isolator element 13 in the illustrated exemplary implementation has a length which corresponds approximately to the axial length of the coupling element 11. The isolator element 13 is provided in the lower end with a flange 13*a* which projects laterally and which, in the illustrated exemplary implementation, is likewise circular or is in the form of a disk and is positioned on the base plate 1 in the area of the recess 3. In more detail, the isolator element (13) has a radially projecting stop, flange or flange section (13*a*) in the area of the foot point on the antenna element (15), via which the isolator element (13) is supported or held with respect to the base plate (1). The foot point (19) of the antenna element (15) rests on the flange (13*a*).

This isolator element 13 is also plugged onto the antenna element 15 which is in the form of a monopole as shown in FIGS. 1 and 2.

The antenna element 15 which is like a monopole has a first antenna section 15*a* and a second antenna section 15*b*. The first antenna section 15*a* is aligned such that it widens conically away from the foot point 19, that is to say its widened conical section points away from the base plate 1. This conical first antenna element section 15*a* is followed by a second cylindrical antenna element section 15*b*, with the diameter of the conical antenna element section at the junction between the first and the second antenna element section corresponding to the diameter of the cylindrical antenna element section. The antenna element thus has an outer surface which extends around the longitudinal axis that runs transversely with respect to the base plate. The antenna element 15 is in this case preferably rotationally symmetrical, is partially rotationally symmetrical, or is at least approximately or essentially radially symmetrical or it transmits and receives symmetrically.

As is also evident from the cross-section illustration shown in FIG. 2, part of the antenna element is a tubular coupling element 15*c* which is formed in the interior and has a free internal diameter which is equal to or slightly larger than the external diameter of the tubular isolator element 13. This coupling section 15*c* thus allows the antenna element, which is in the form of a monopole, to be pushed onto the isolator element 13 until the lowermost contact surface 15' of the antenna element 15, that is to say the foot point 19 of the antenna element, rests on the isolator flange 13*a* of the isolator element 13, and is thus electrically conductively isolated from the base plate 1.

The axial length of the coupling element 15*c* is generally longer than the axial length of the isolator element 13 and/or the length of the first coupling element 11 on the feed cable side. The length of the hollow cylindrical isolator 13 is in this case comparatively non critical, and it may also be considerably shorter. The isolator is essentially used only to mechanically hold the antenna element 15. In the particular example implementation shown, the isolator contributes to no section of the antenna element 15, and in particular not the coupling section 15*c*, being electrically conductively able to touch the coupling element 11, which is electrically in contact with the inner conductor.

The two parallel first and second coupling elements 11 and 15*c* which are electrically conductively isolated and are even arranged coaxially with respect to one another in the illustrated exemplary implementation form a series (capacitive) line coupling at the foot point of the antenna element 15 (e.g., a series or capacitive inner conductor coupling). The length of the first and second coupling elements 11 and 15*c*, respectively, should thus preferably be chosen such that the desired optimum coupling can be provided for the various frequency ranges. The coupling element 15*c* which forms one part of the antenna element arrangement is thus generally chosen to be longer than the length of the coupling element 11 on the feed cable side. The length of the coupling element 11 on the feed side is preferably chosen as a function of the upper frequency bands, such that this length is approximately Lambda/4 ($\lambda/4$) or n×Lambda/4 ($n\times\lambda/4$), where n is an odd integer number, that is to say $n\times\lambda=1, 3, 5 \ldots$. In one example illustrative implementation, the axial length of the first coupling element (11) is $\lambda/4-40\%\ \lambda/4<\text{axial length}<\lambda/4+40\%\ \lambda/4$, and preferably $\lambda/4-20\%\ \lambda/4<\text{axial length}<\lambda/4+20\%\ \lambda/4$, with lambda being the mean wavelength of the frequency band to be transmitted. Alternatively, the axial length of the first coupling element (11) may be $(n\times\lambda/4)-40\%\ (n\times\lambda/4)<\text{axial length}<(n\times\lambda/4)+40\%\ (n\times\lambda/4)$, and preferably $(n\times\lambda/4)-20\%\ (n\times\lambda/4)<\text{axial length}<(n\times\lambda/4)+20\%\ (n\times\lambda/4)$, where $n=1, 3, 5 \ldots$. The first coupling element (11) may be designed for the lowermost frequency in one of the two or more frequency bands, such that it is small in comparison to Lambda/4, where Lambda represents the mid frequency of the relevant frequency band.

The open end of the line coupling is thus connected (at the mid frequency of the respective band) to the feed point 15' via a short circuit, that is to say conductively. The coupling element 11 on the feed cable side is thus both capacitive and inductive at the limit frequencies. For the frequencies for which the length of the coupling element 11 on the feed side is Lambda/2, this results in a resonance, that is to say the open end at the foot point 15' of the antenna element 15 acts as an open circuit (high impedance). For the lowermost frequency band (in the illustrated and explained exemplary implementation, that is to say the band from about 800 to 1000 MHz), the length of the coupling element 11 on the feed cable side is very short in comparison to lambda/4 (that is to say 11<<lambda/4) and thus forms a series capacitance, which allows broadband impedance matching at this frequency and is also a governing factor for a small physical structure.

Figure 3:
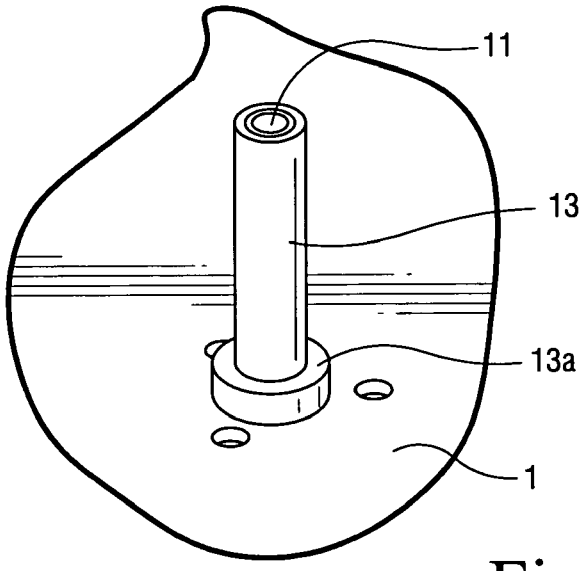
FIG. 3 shows a schematic perspective illustration of an exemplary illustrative non-limiting coupling part which projects from the base plate 1, is in the form of a rod, and is electrically connected to the feed line.

FIG. 3 shows a schematic perspective illustration of an exemplary first electrically conductive coupling element 11, which is in the form of a rod, with the antenna element 15 removed, and with the coupling element being electrically conductively connected in the area of the recess 3 to the coaxial plug element that is located on the lower face of the base plate 1, that is to say in the inner conductor plug there.

As can be seen from the schematic perspective illustration in FIG. 3, the tubular isolator element 13 is just plugged onto this first coupling element 11. Isolator element 13 is preferably composed of plastic and has a good dielectric constant value. As stated, the second internal tubular element 15*c* of the antenna element 15 can then be plugged onto this.

Figure 4:
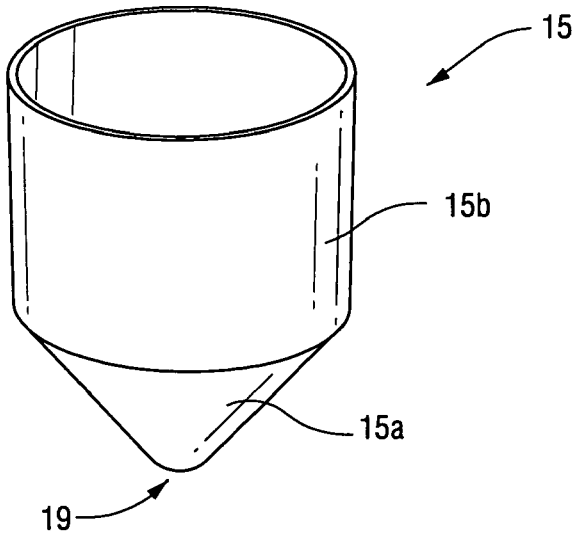
FIG. 4 shows a schematic perspective illustration of a first exemplary illustrative non-limiting alternative antenna element.

FIG. 4 shows the antenna element 15 on its own, in the form of a perspective illustration, subdivided into a conical antenna element section 15*a* and a cylindrical antenna element section 15*b*.

Figure 6:
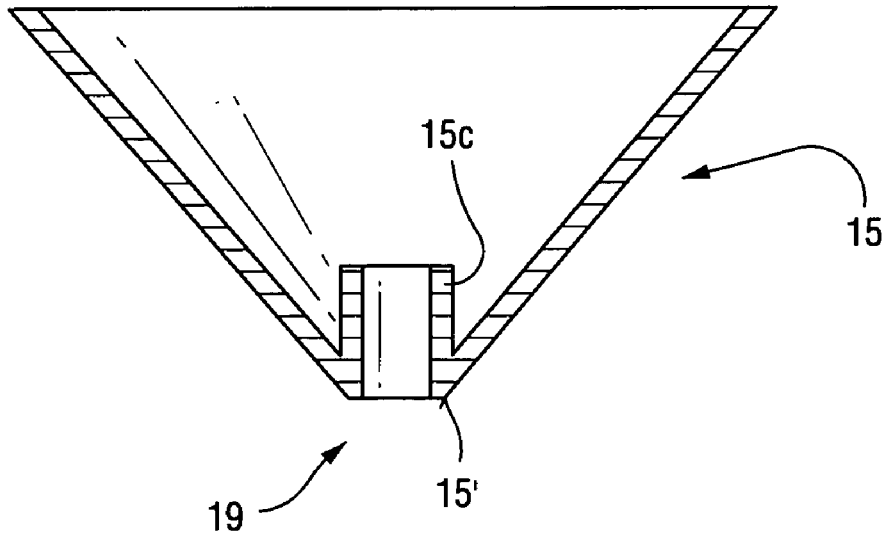
FIG. 6 shows an axial cross section through a modified exemplary illustrative non-limiting conical or truncated conical antenna element shape.

FIG. 6 shows a schematic cross section illustration of a modified exemplary implementation of an antenna element which comprises just one conical antenna element 15, which may have a truncated conical shape.

Figure 5:
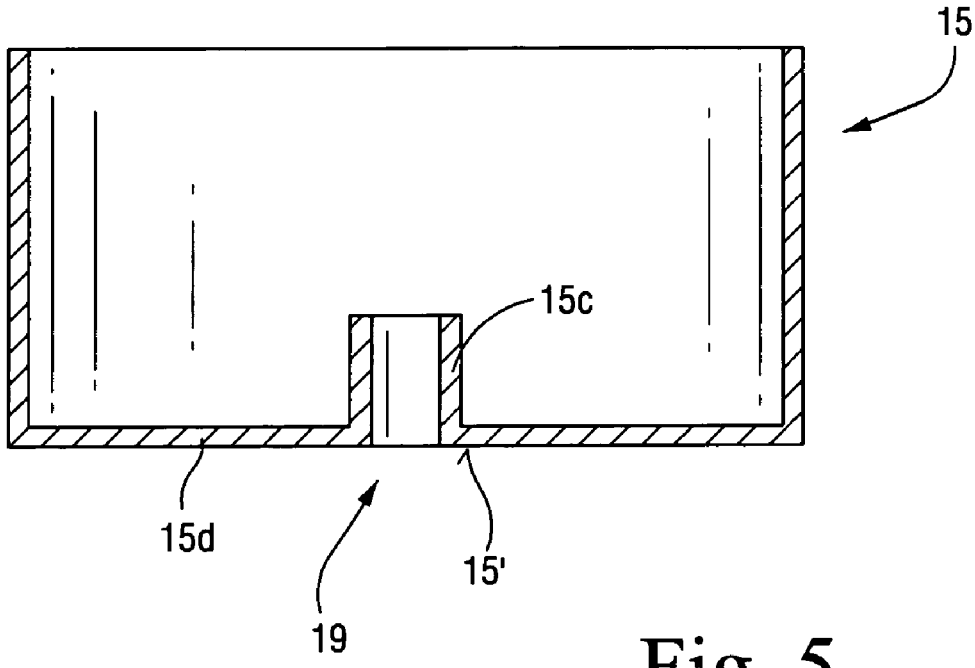
FIG. 5 shows an axial cross-section illustration through a further modified exemplary illustrative non-limiting antenna element shape.

Corresponding to the cross section illustration shown in FIG. 5, this shows that, in this case, only one antenna element, which is cylindrical or is in the form of a pot and is like a monopole, is used as the antenna element 15, and does not have a conical section. In this situation, the coupling element 15*c* is connected by means of a radial connecting or base section (15*d*) to the outer casing of the cylindrical antenna element (15). In more detail, the coupling element (15*c*) which is part of the antenna element (15) is connected on its side which faces the base plate (1) to the conical or truncated conical antenna element or antenna element section (15, 15*a*), or is connected to the remaining casing section of the antenna element (15) by the interposition of a connecting section (15*d*) which preferably runs parallel to the base plate (1).

The coupling section 15*c*, which forms part of the antenna element arrangement, is seated centrally and internally is in the form of a hollow cylinder, as shown. In each case, the coupling section, both in the exemplary implementations of FIG. 5 and FIG. 6, is then plugged onto the first coupling element 11, engaging over it and preferably with the interposition of a hollow cylindrical isolator.

An antenna element as shown in FIG. 5 makes it possible to produce a physically small omnidirectional antenna which can be operated in particular in low frequency ranges. An antenna element as shown in FIG. 6, that is to say an antenna element which is only conical or in the form of a truncated cone, results in a physically small antenna which can be operated in particular in high frequency bands. Preferably, however, for a multiband design, an antenna type having an antenna element as shown in FIGS. 1 and 2 is provided, whose bandwidth covers both relatively low as well as high and very high frequency ranges and bands.

The described antenna type not only makes it possible to produce a very broadband antenna but also, in particular, the serial feed allows the antenna element height to be minimized, thus in turn also allowing the counterweight area (base plate) to be designed to be smaller. The described antennas thus have the advantage that they have a broader bandwidth with a smaller physical size than conventional antennas and, at the same time, can be assembled, installed and produced even more easily, since, in principle, each of the respective antenna elements, with its integrated coupling element 15*c*, just has to be pushed onto the first coupling element 11, which is electrically connected to the feed line.

In principle, there is no need for an isolator element 13 provided only that the antenna element, which is in the form of a monopole, can be arranged with its coupling element 15*c* electrically conductively isolated from the first coupling element 11. For this purpose, it may be sufficient for the antenna element to be held and fixed only in the area of its foot point on an isolator element which is in the form of a disk or plate, so that the two coupling elements 11 and 15*c* do not make any electrical contact.

Variations to the above-described exemplary illustrative non-limiting implementations are possible. For example, in contrast to the illustrated exemplary implementations, the plug element 5 need not necessarily be a female connector (for example an N female connector). It is also possible to use a permanently connected cable, that is to say in particular with the inner conductor of a coaxial cable being positioned appropriately such that it is used as the coupling element 11 on the feed side, in a corresponding manner to the illustrations in the drawings. The chosen expression "coupling element 11 on the feed side" may thus also be understood as meaning an implementation in which the coupling element 11 represents the end of a corresponding feed conductor (preferably the end of the inner conductor of a corresponding coaxial feed line cable).

In a further exemplary modification, it is likewise possible to provide a prefabricated unit for the coupling element 11 which is on the feed conductor side, the isolator 13 which surrounds the coupling element 11 and, preferably and furthermore, also the plug element 5 including the inner conductor 7*a*. In more detail, for example, isolator (13) on the first coupling element (11) can be composed of a sprayed on plastic or sprayed on dielectric. Such a prefabricated unit can be handled as an entity, and may be inserted in and mechanically anchored on a corresponding hole in the base plate 1, in order then just to only fit the antenna element 15 with its coupling element 15*c* on the antenna element side.

Figure 7:
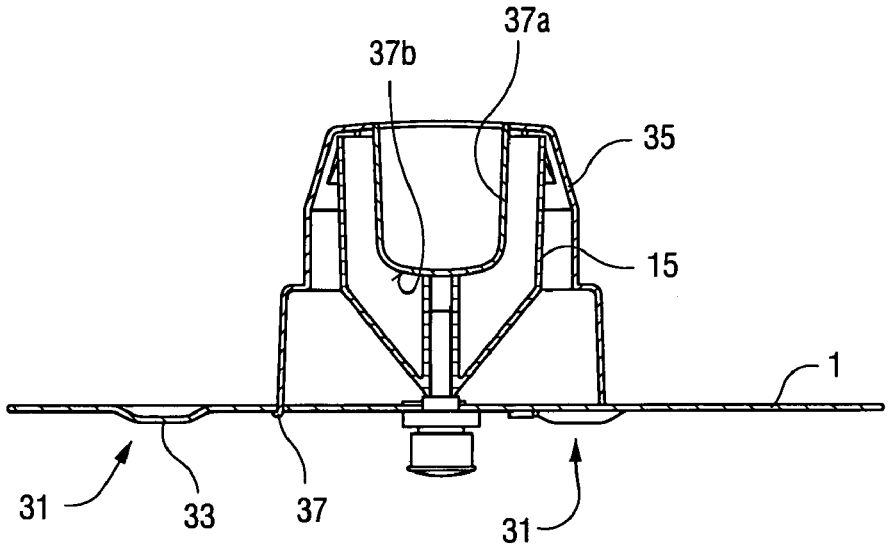
FIG. 7 shows an axial cross section through the exemplary illustrative non-limiting antenna in a first fitted inner shroud.
Figure 8:
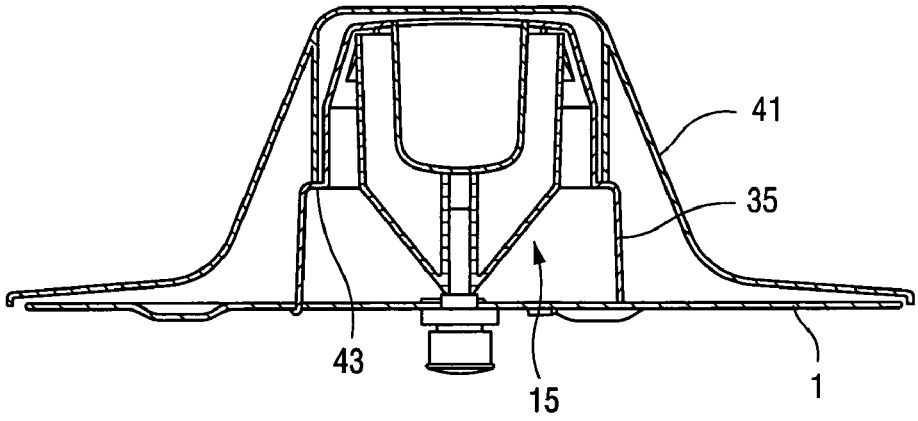
FIG. 8 shows a cross section illustration corresponding to that in FIG. 7, in which an outer shroud which covers everything is fitted to the inner shroud.

As is evident from the cross section illustration shown in FIGS. 7 and 8, the exemplary illustrative non-limiting reflector has indentations or so called mounting points 31 which are recessed at a number of points that are located offset from the center. In each indentation, a hole 33 is incorporated, in order to make it possible to attach the reflector in an appropriate manner to a mount, by the insertion of screws.

The entire exemplary illustrative non-limiting antenna arrangement is held and fixed by means of an inner shroud 35. The inner shroud 35 has latching or clipping elements 37 which are located offset in the circumferential direction on the reflector side and can be inserted into corresponding stamped out areas or openings in the reflector 1. In the snapped in state, the latching elements 37 then latch behind the stamped areas in the reflector, thus ensuring that the antenna and the inner shroud 37 are held securely, without any further installation measures.

In this exemplary illustrative non-limiting implementation, the inner shroud 35 is designed such that, centrally, it has a holding section 37*a* which engages at the bottom in the cup shaped antenna element. A reflector side end face 37*b* secures the antenna element in the plugged on position. The end face 37*b* of the inner shroud may in this case touch the upper end face, which faces it, of the coupling element 15*c* on the antenna element side. This inner shroud thus secures and fixes the antenna element 15 against sliding out axially and thus against radial tilting.

A so called outer shroud 41 can be fitted such that it covers everything, in which case the outer shroud may likewise latch in via latching or clipping elements 37. Exemplary illustrative non-limiting latching or clipping elements 37 may be located internally, for example on a step on the inner shroud in openings that are incorporated there, and/or in openings in the reflector, to be precise. Such corresponding latching or clipping elements may be passed through the opening and can latch in behind the corresponding material sections of the inner shroud and/or of the reflector. The outer shroud is in this case designed such that it extends over and thus covers everything, including the reflector.

The inner shroud 35 and outer shroud 41 are, in this example illustrative non-limiting implementation, manufactured from a material which is particularly transparent to electromagnetic beams in the frequency range to be transmitted.

Various exemplary illustrative non-limiting implementations of the antenna element 15 do not necessarily need to be composed of conductive material from the start. In one exemplary illustrative non-limiting implementation, antenna element (15) is composed of plastic, in particular being an injection molded plastic part, which is provided with a conductive coating. However, antenna element 15 may also be formed from other non conductive material, for example plastic. In this case, the antenna element 15 should have, or else be provided with, a suitable electrically conductive layer on its inner and/or outer surface, or in some other way.

The invention is not to be limited to the disclosed exemplary illustrative non-limiting implementations, but to the contrary, is intended to cover various modifications and equivalent arrangements included within the scope of the claims.

The invention claimed is:

1. A broadband omnidirectional antenna comprising:

an antenna element in the form of a monopole, the antenna element projecting from a base plate and arranged such that it is electrically conductively isolated from the base plate, the antenna element having at least a first antenna section which widens conically or at least partially conically away from the base plate at a foot point, the base plate having a recess in the area of the foot point, the antenna element comprising a first coupling element and a second coupling element, the first coupling element comprising a rod-like structure, the second coupling element comprising a tubular structure, whereby the first coupling element is inserted into the second coupling element, the first coupling element projecting from the base plate and being isolated from the base plate, the first coupling element being electrically connectable with a feed line, the second coupling element being electrically connected with the antenna element, said first and second coupling elements providing a series or capacitive inner conductor line coupling, the second coupling element being positioned within the antenna element first antenna section.

2. The antenna according to claim 1, further including a feed line and wherein the first coupling element extends transversely with respect to and preferably at right angles to the base plate and is, electrically connected to the feed line such that it is electrically conductively isolated from the base plate.

3. The antenna according to claim 1, wherein the first and second coupling elements are electrically conductively connected to or part of the antenna element, said coupling elements not being conductively connected to one another providing series line coupling.

4. The antenna according to claim 1, wherein the antenna has or comprises at least one cylindrical antenna element section.

5. Antenna according to claim 1, wherein the antenna element first antenna element section widens conically away from the base plate and merges into a cylindrical antenna element section.

6. The antenna according to claim 1, wherein the second coupling element is part of the antenna element and has a side which faces the base plate, said side being connected to a conical or truncated conical antenna element section, by the interposition of a connecting section running parallel to the base plate.

7. The antenna according to claim 1, wherein the antenna operates on a predetermined frequency band centered at a mean wavelength $\lambda$, and wherein the axial length of the first coupling element is $\lambda/4-40\%\ \lambda/4<\text{axial length}<\lambda/4+40\%\ \lambda/4$.

8. The antenna according to claim 1, wherein the antenna operates at a mean wavelength $\lambda$, and wherein the axial length of the first coupling element is $(n\times\lambda/4)-40\%\ (n\times\lambda/4)<\text{axial length}<(n\times\lambda/4)+40\%\ (n\times\lambda/4)$, where n=1, 3, 5 . . . .

9. The antenna according to claim 1, wherein the axial length of the first coupling element is designed for the lowermost frequency in one of the two or more frequency bands, such that it is small in comparison to Lambda/4, where Lambda represents the mid-frequency of the relevant frequency band.

10. The antenna according to claim 1, wherein the antenna element is composed of electrically conductive material.

11. The antenna according to claim 1, wherein the antenna element comprises an injection-molded plastic part provided with a conductive coating.

12. The antenna of claim 1 wherein the first coupling element is positioned within a conical void formed within a conically widening portion of said first antenna section.

13. The antenna according to claim 1, wherein the first coupling element and the isolator element comprise a unit which can be handled as an entity, the isolator on the first coupling element being composed of a sprayed-on substance.

14. Antenna according to claim 13, wherein the first coupling element is mounted on a base plate to comprise a unit which can be handled as an entity by means of the isolator element which is located thereon and a plug element anchored on the base plate.

15. The antenna according to claim 1, wherein the antenna element is covered by a shroud, by means of which the antenna element is protected against axial sliding and radial tilting.

16. The antenna according to claim 15, wherein the covering device comprises an inner shroud and an outer shroud, the outer shroud covering everything can be fitted on the inner shroud, the outer shroud being anchored on the inner shroud and/or on the reflector, via a clipping and/or a latching device.

17. The antenna according to claim 1, further comprising a reflector and a covering device comprising an inner shroud attached to the reflector by a clipping and/or latching device.

18. The antenna according to claim 17, wherein the inner shroud has a central fixing section which projects into the interior of the cup-shaped antenna element, presses against the adjacent end face of the second coupling element and thus protects the antenna element against axial movement and/or radial tilting.

19. The antenna according to claim 1 further including a tubular isolator element arranged between the first coupling element and the second coupling element.

20. The antenna according to claim 19, wherein the isolator element has a radially projecting stop, flange or flange section in the area of the foot point on the antenna element via which the isolator element is supported or held with respect to the base plate.

21. The antenna according to claim 20, wherein the foot point of the antenna element rests on the flange.

22. The antenna according to claim 21, wherein the first coupling element is part of a feed conductor and is formed from the inner conduct of a coaxial feed line.

23. The antenna according to claim 22, wherein the first coupling element is formed from the inner conductor of a coaxial feed line.

24. A multiband indoor omnidirectional antenna comprising:

a base plate;

a monopole antenna element projecting from and electrically isolated from the base plate, said monopole antenna element comprising a tubular conical section and a cylindrical section, said tubular conical section operating as a radiator for a first frequency band, said cylindrical section operating as a radiator for a second frequency band lower than said upper frequency band; and a series inner conductor line coupler for feeding the antenna element, said inner conductor line coupler comprising a tubular coupling structure and a rod-like coupling structure that is insertable into said tubular coupling structure to couple with said monopole antenna element, the rod-like coupling structure projecting from the base plate and being isolated from the base plate, the rod-like coupling structure being electrically connectable with a feed line, the tubular coupling structure being electrically connected with the antenna element, said rodlike coupling structure and the tubular coupling structure providing a series or capacitive inner conductor line coupling, the series inner conductor line coupler being positioned within the antenna element tubular conical section.

25. The antenna of claim 24 wherein said antenna operates on a predetermined frequency band having a mean wavelength $\lambda$, and wherein said coupler has an axial length of $\lambda/4-40\%\ \lambda/4<\text{axial length}<\lambda/4+40\%\ \lambda/4$.

26. The antenna of claim 24 wherein said antenna operates on a predetermined frequency band having a mean wavelength λ, and wherein said coupler has an axial length of $(n\times\lambda/4)-40\%\ (n\times\lambda/4)<\text{axial length}<(n\times\lambda/4)+40\%\ (n\times\lambda/4)$, where n=1, 3, 5 . . . .

27. The antenna of claim 24 wherein said coupler provides both capacitive coupling and inductive coupling at least at limit frequencies.

28. The antenna of claim 24 wherein for some frequencies of interest the electrical length of the coupler is a half wavelength which results in a resonance such that open end at the base of the antenna element acts as an open circuit, and for other frequencies of interest the length of the coupler is short in comparison to quarter wavelength and thus forms a series capacitance allowing broadband impedance matching.

29. The antenna of claim 24 wherein said coupler provides capacitive and inductive coupling.

30. The antenna of claim 24 wherein the series inner conductor line coupler is positioned within a hollow formed by the tubular conical section.

* * * * *